US010273980B2

(12) United States Patent
Chen et al.

(10) Patent No.: US 10,273,980 B2
(45) Date of Patent: Apr. 30, 2019

(54) LIQUID SEAL ENERGY-ACCUMULATOR AND HYDRAULIC SYSTEM THEREOF BASED ON LIQUID-COLLECTOR AND SANDWICH PISTON

(71) Applicants: Qixing Chen, Hunan (CN); Qiyu Luo, Beijing (CN)

(72) Inventors: Qixing Chen, Hunan (CN); Qiyu Luo, Beijing (CN)

( * ) Notice: Subject to any disclaimer, the term of this patent is extended or adjusted under 35 U.S.C. 154(b) by 316 days.

(21) Appl. No.: 15/028,715

(22) PCT Filed: Sep. 28, 2014

(86) PCT No.: PCT/CN2014/000876
§ 371 (c)(1),
(2) Date: Apr. 12, 2016

(87) PCT Pub. No.: WO2015/043117
PCT Pub. Date: Apr. 2, 2015

(65) Prior Publication Data

US 2016/0369822 A1 Dec. 22, 2016

(30) Foreign Application Priority Data

Sep. 27, 2013 (CN) ..... 2013 1 0468881
Sep. 24, 2014 (CN) ..... 2014 1 0489979

(51) Int. Cl.
*F15B 1/24* (2006.01)
*F15B 20/00* (2006.01)
(Continued)

(52) U.S. Cl.
CPC ..... *F15B 1/24* (2013.01); *F15B 11/08* (2013.01); *F15B 13/044* (2013.01);
(Continued)

(58) Field of Classification Search
CPC .... F15B 1/24; F15B 20/005; F15B 2201/205; F15B 2201/31; F15B 2201/312; F15B 2201/405
(Continued)

(56) References Cited

U.S. PATENT DOCUMENTS 2,811,950 A * 11/1957 Entz ..... B66F 3/25 254/93 R

FOREIGN PATENT DOCUMENTS

CN 102840185 A 12/2012
CN 103016724 A 4/2013
(Continued)

OTHER PUBLICATIONS

Chen Qixing, Luo Qiyu, Automobile Hydraulic Boosting System: Research on Supercritical CO2 High Hydraulic Storage Tank, Chinese Journal of Automotive Engineering, vol. 3 No. 2 Mar. 2013, p. 151-156.

*Primary Examiner* — Michael Leslie
*Assistant Examiner* — Matthew Wiblin

(57) ABSTRACT

A liquid seal energy-accumulator and hydraulic system thereof based on liquid-collector and sandwich piston is provided. The liquid seal energy-accumulator includes a piston cylinder (HSG) and a high pressure gas-tank (QTG). When a piston (HS) moves to a top of the piston cylinder, the leaked pressure liquid accumulated on the top of the piston flows into the gas-tank through a gas-liquid-pipe (TD), so as to timely clean up the pressure liquid accumulated on the top of the piston. The pressure liquid collected at the bottom of the gas-tank is increased for upwardly moving a buoy (FT), when the buoy presses a collection-liquid sensor (JYG), a signal is sent for opening an electronically-controlled-valve (DKF), the leaked pressure liquid flows from the liquid leakage pipe (LYG) back to the liquid-container (SYT).

9 Claims, 6 Drawing Sheets

(51) Int. Cl.
*F15B 11/08* (2006.01)
*F15B 13/044* (2006.01)

(52) U.S. Cl.
CPC ..... *F15B 20/005* (2013.01); *F15B 2201/312* (2013.01); *F15B 2201/405* (2013.01); *F15B 2201/411* (2013.01); *F15B 2201/50* (2013.01); *F15B 2211/205* (2013.01); *F15B 2211/275* (2013.01); *F15B 2211/625* (2013.01); *F15B 2211/7051* (2013.01)

(58) Field of Classification Search
USPC ..... 92/86
See application file for complete search history.

(56) References Cited

FOREIGN PATENT DOCUMENTS

| | | | | | |
|---|---|---|---|---|---|
| DE | 4115342 | A1 | * | 11/1992 | ..... F15B 1/08 |
| EP | 854296 | A2 | * | 10/1997 | ..... F15B 1/24 |
| FR | 1107500 | A | * | 1/1956 | ..... F15B 1/25 |
| FR | 1368353 | A | * | 7/1964 | ..... F15B 1/24 |
| FR | 1467909 | A | * | 2/1967 | ..... F15B 1/24 |
| WO | WO2012159455 | | | 11/2012 | |
| WO | WO 2013154566 | A1 | * | 10/2013 | ..... E21B 19/006 |

* cited by examiner

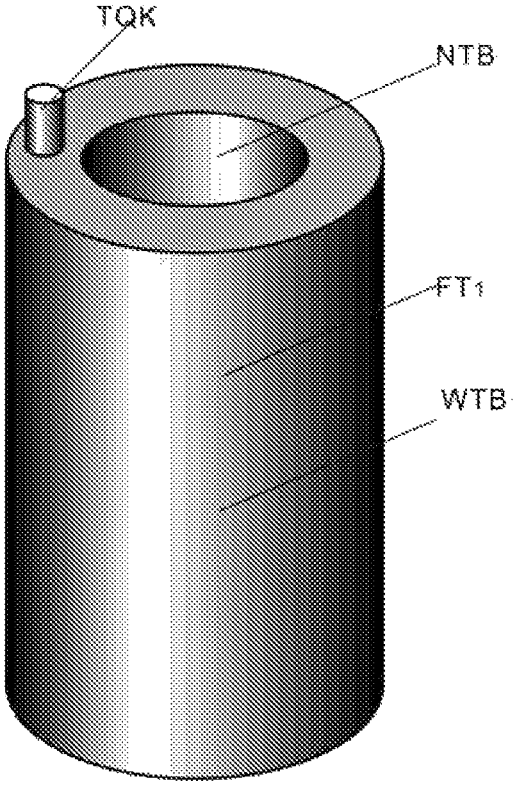
Fig. 1.1

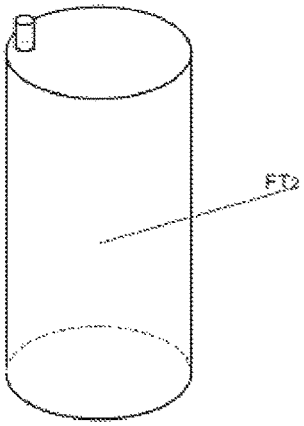
Fig. 2.1
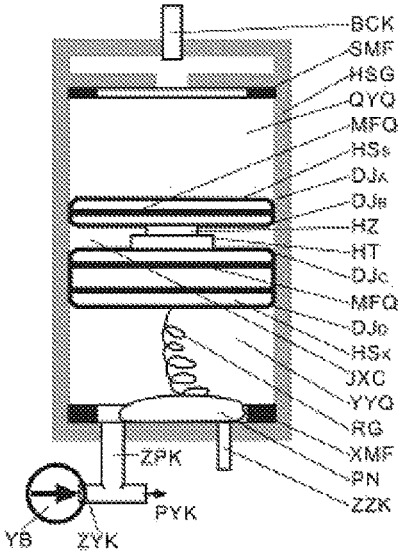
Fig. 3
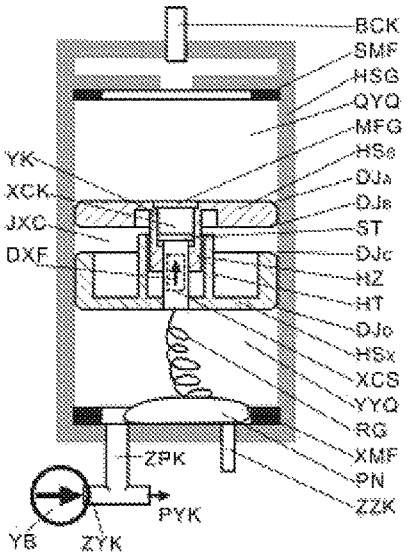
Fig. 3.1

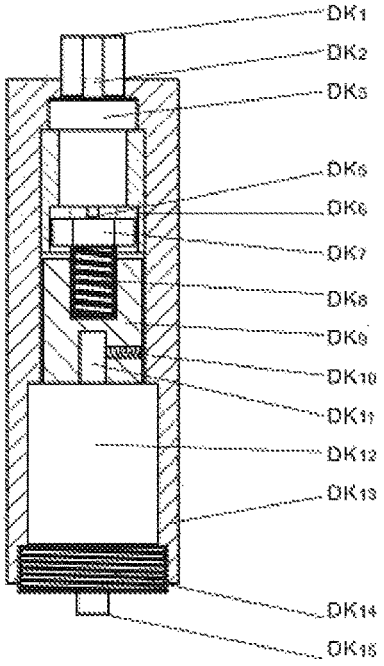
Fig. 4
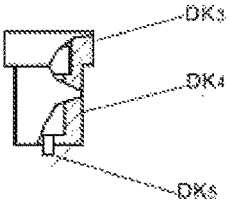
Fig. 4.1

LIQUID SEAL ENERGY-ACCUMULATOR AND HYDRAULIC SYSTEM THEREOF BASED ON LIQUID-COLLECTOR AND SANDWICH PISTON

CROSS REFERENCE OF RELATED APPLICATION

This is a U.S. National Stage under 35 U.S.C 371 of the International Application PCT/CN2014/000876, filed Sep. 28, 2014, which claims priority under 35 U.S.C. 119(a-d) to CN 201310468881.5 filed Sep. 27, 2013; and CN 201410489979.3, filed Sep. 24, 2014.

BACKGROUND OF THE PRESENT INVENTION

Field of Invention

The present invention is an energy-accumulator and a hydraulic control system thereof, which belongs to a field of hydraulic transmission system. The present invention is referred as liquid seal energy-accumulator.

Description of Related Arts

Currently, there are three kinds of energy-accumulators: capsule-type energy-accumulators, piston-type energy-accumulators and diaphragm-type energy-accumulators. Both the peltry-type energy-accumulators and the membrane-type energy-accumulators have the risk that the rubber sudden ruptures, so they are not adapted for systems with high requirements for reliability, such as vehicles, ships and aircrafts. The piston-type energy-accumulators have not the risk that the rubber sudden ruptures, so they have high reliability; meanwhile, currently, they face important issues: the excellent performance of the piston for separating gas from liquid, and the small friction force between the piston and the cylinder body, which are a pair of contradictions. Specifically, if the isolation performance between gas and liquid is improved, the positive pressure of the piston sealing ring relative to the cylinder body needs to be increased for increasing the friction, so that the response is insensitive; on the contrary, if the response sensitivity is improved, the friction of the piston should be reduced, which results in poor isolation performance between gas and liquid, so that the liquid leaks towards the gas-pressure-chamber and the gas leaks.

SUMMARY OF THE PRESENT INVENTION

If the above shortcomings are able to be overcome, the piston-type energy-accumulator has excellent isolation performance between gas and liquid and high response sensitivity, the piston-type energy-accumulator has more broad application prospects. For example, it acts as the power assisting device in vehicles, ships and aircrafts. The concrete objects of the energy-accumulator provided by the present invention are: (1) safe and reliable, without sudden damage; (2) good gas liquid isolation performance; (3) high response sensitivity; (4) durable; (5) highly operational pressure and quasi-constant pressure; (6) high efficiency; (7) small volume; (8) low manufacturing cost; (9) simple structure and convenient maintenance; and (10) based on the energy-accumulator, the corresponding control system can be designed to drive the brake, the diverter, the accelerator, the clutch, the selector mechanism, the aircraft elevator and other executing mechanisms.

To simply and conveniently describe, some promises are given as follows.

(1) The hydraulic-pressure-chamber YYQ is full of the pressure liquid YLY, while the pressure liquid YLY is not shown in the drawings and is only described in the specification; similarly, the high pressure gas GYQT in the gas-pressure-chamber QYQ is not shown in the drawings.

(2) There are three pressure (temperature) preset values: nominal value, upper limit value and lower limit value; the quasi constant pressure (quasi constant temperature) means that the pressure (temperature) varies within a small range which takes the preset nominal value as the center, or varies between the preset upper limit value and the preset lower limit value.

(3) The sensor always combines with the comparator to generate the control signal. For example, a "liquid supplement threshold potential" is preset in the position comparator, when a spring length reaches one defined length, the potential intensity of the signal outputted by the position sensor is over the "liquid supplement threshold potential", and at this time, the output valve of the position comparator turns to send the "liquid injecting signal" to the liquid injection pump, so as to start the liquid injection pump for injecting the liquid into the hydraulic-pressure-cylinder. The above process is referred as the position sensor/comparator sends the liquid injecting signal. Similarly, the pressure-sensor/comparator sends the heating or cooling signal, and the liquid filled sensor sends the stopping signal. The comparator is designed to be in the control system and is not shown in the drawings.

(4) References of components are represented by capital letters, and numerical subscripts are serial numbers of the components, such as $ZK_1$, $GZG_2$ and $DK_1$. The subscript k is the wildcard of the subscript 1, 2, . . . n.

(5) A sealing ring is provided on the piston, which is usually not emphasized, a cylinder within which the piston moves is called as the piston cylinder, and a highest position of the piston cylinder is called as a top of the piston cylinder.

(6) A full name of the liquid-collector is "liquid collecting and leaking device", which is capable of not only collecting the liquid but also discharging liquid.

(7) The signal wires of all sensors are represented by XHX, which are not shown in detail one by one.

(8) The high pressure gas-tank and the high pressure gas-chamber are respectively referred as the gas-tank QTG and the gas-chamber QTQ.

The liquid seal energy-accumulator works based on the high pressure gas, so before describing the working principle of the liquid seal energy-accumulator, the high pressure gas GYQT and the known piston type energy-accumulator are firstly introduced.

Within the normal temperature range (−20° C.-100° C.), the high pressure GYQT comprises super fluid (such as $CO_2$), gas (such as nitrogen and argon), and vapor-liquid coexistent saturated vapor BHQ (such as refrigerant freon and ammonia); the high pressure gas is also called as pressure storage gas or pressure storage agent.

The basic principle of the known piston type energy-accumulator is as follows:

One piston HS divides the piston cylinder HSG into the gas-pressure-chamber (upper chamber) and the hydraulic-pressure-chamber (lower chamber), the gas-pressure-chamber is injected with the high pressure gas with a pressure of $P_Q$, a liquid injecting and discharging pipe ($ZP_K$, referred to as injecting/discharging pipe) is located at the bottom of the hydraulic-pressure-chamber for allowing the pressure liquid with a pressure of $P_Y$ to be injected and discharged, the friction force of the piston is $F_M$; the area of the piston is S, when the liquid injection pump injects the liquid into the hydraulic-pressure-chamber, $P_Q+F_M/S=P_Y$; when the hydraulic-pressure-chamber outwardly discharges the liquid to do work, $P_Q=P_Y+F_M/S$, (references $P_Q$, $P_Y$, $F_M$, and S are irrelevant with the drawings and are just for theoretical analysis); in generally, $P_Q$ and $P_Y$ are much greater than $F_M/S$, it can be regarded as $P_Q \approx P_Y$, thereby the pressure liquid in the hydraulic-pressure-chamber has a very high pressure.

Currently, the main problems are: to prevent the pressure liquid in the hydraulic-pressure-chamber from leaking to the gas-chamber, the piston sealing ring must tightly press the inner wall of the piston cylinder, so as to reduce the response sensitivity of the piston. The present invention effectively improves the response sensitivity of the piston.

The basic principle of the present invention: a liquid seal energy-accumulator and hydraulic system thereof based on a liquid-collector and a sandwich piston is provided; a liquid-collector is used to collect the pressure liquid which leaks from the piston, a gas-tank (QTG) is the tank of liquid-collector for collecting the leakage pressure liquid, its bottom connects a liquid leakage pipe (LYG) to a liquid-container (SYT), in the middle of the leakage pipe (LYG), there is an electronically-controlled-valve (DKF) to for controlling the ON/OFF of the leakage pipe; wherein the liquid seal energy-accumulator comprises a sealing cylindrical piston cylinder (HSG), wherein a piston (HS) divides the piston cylinder (HSG) into a gas-pressure-chamber and a hydraulic-pressure-chamber, there are several sealing rings on the piston (HS), the hydraulic-pressure-chamber (YYQ) is injected full with pressure fluid, and the gas-pressure-chamber is injected with high pressure gas, the gas pressure is transmitted to the hydraulic-pressure-chamber by the piston, so that a pressure liquid in the hydraulic-pressure-chamber has a very high pressure, an injecting/discharging pipe ($ZP_K$) is located at the bottom of the hydraulic-pressure-chamber, and connects to a liquid injection pump (YB), for injecting the pressure liquid to store a pressure energy and discharging the pressure liquid to output the pressure energy;

further comprising a gas-chamber (QTQ, including $QTQ_1$ and $QTQ_2$) formed by a high pressure gas-tank (QTG, including $QTG_1$ and $QTG_2$, referred to as "gas-tank" for storing high pressure gas), a gas-liquid-pipe (TD, including $TD_1$ and $TD_2$) is located at a top of the piston cylinder for communicating the gas-chamber (QTQ) with the gas-pressure-chamber (QYQ); the gas-tank has two functions: one is an extension of the gas-pressure-chamber (QYQ) for helping the gas-pressure-chamber to store the high pressure gas, thus increasing a total volume and decreasing a pressure fluctuation of the gas-pressure-chamber; the other is serving as a liquid-collector (at the bottom of the gas-tank), because a small amount of leakage always occurs in the piston, the pressure liquid slowly leaks from the hydraulic-pressure-chamber (YYQ) to the gas-pressure-chamber (QYQ), so that more and more pressure liquid accumulates on the top of the piston which needs to be cleaned up; when the piston moves to a top of the piston cylinder, the pressure liquid on the top of the piston flows into the gas-chamber (QTQ) through the gas-liquid-pipe (TD), in such a manner that the pressure liquid on the top of the piston is timely cleaned up, and the pressure liquid collected at a bottom of the gas-chamber becomes more and more. At the bottom of the gas-tank (QTG), there is a leakage pressure fluid recycling pipe (LYG, referred to as liquid leakage pipe) connected to a liquid-container (SYT), in the middle of the liquid leakage pipe (LYG), there is an electronically-controlled-valve (DKF) to control ON/OFF of the liquid leakage pipe; there is a buoy (FT, including $FT_1$ and $FT_2$) within the gas-chamber (QTQ), collection fluid increase makes the buoy (FT) rise, so that the buoy (FT, including $FT_1$ and $FT_2$) moves upwardly with increasing the collected-liquid; above the buoy ($FT_1$), there is a collection-liquid sensor (JYG), when the buoy presses a collection-liquid sensor (JYG), the sensor sends an "ON" signal to an electronically-controlled-valve (DKF) for opening the electronically-controlled-valve to release the collected pressure liquid (referred as the collected liquid), the collected liquid flows from a liquid leakage pipe (LYG) back to a liquid-container (SYT); when the collected-liquid is leaved out, the buoy falls off till the buoy presses a bottom sensor (DDG), the bottom sensor sends a closing electronically-controlled-valve signal for closing the electronically-controlled-valve.

Another important feature is: there is a sandwich piston for strengthening the sealing performance of the piston, reducing the friction loss, and improving the response sensitivity. The piston comprises a pair of "half piston", namely, the piston comprises an "upper-half-piston" (HSs) and a "lower-half-piston" ($HS_X$), the "upper-half-piston" (HSs) slidably matching with the "lower-half-piston" ($HS_X$) by a sliding column (HZ) and a sliding sleeve (HT), so as to form a sandwich layer (JXC) full of sealing liquid (including sealing grease and pressure liquid) with a changeable distance between the upper-half-piston (HSs) and the lower-half-piston ($HS_X$); due to the pressure of the piston cylinder inner wall with the sealing ring is smaller, the pressure of the hydraulic chamber with the gas-pressure-chamber is smaller, the pressure of the sandwich lies in a middle of the pressure of the hydraulic-pressure-chamber and the pressure of the gas-pressure-chamber and is approximately equal to the two. The one stage pressure of the hydraulic-pressure-chamber/gas-pressure-chamber is divided into hydraulic-pressure-chamber/sandwich layer secondary pressure and sandwich layer/gas-pressure-chamber two stage pressure, so that the leakage from the hydraulic-pressure-chamber and the gas-pressure-chamber to the sandwich layer is greatly reduced to form the micro pressure difference leakage; the highest point and the lowest point of the stroke of the bolt head (ST) and the stroke bolt (XCS) are limited by a stroke hole (XCK), so that the maximum thickness of the sandwich layer is limited to prevent the sliding column from detaching from the sliding sleeve; a sealing cover (MFG) ensures the sealing of the stroke hole, the bottom of the stroke bolt is welded at the bottom of the lower-half-piston for ensuring the sealing, so that all the sandwich layer, the stroke bolt, the sliding column and the sliding sleeve are in a sealing range.

Measures for stabilizing the pressure: the pressure of the high pressure gas is adjusted by the temperature of the high pressure gas, for achieving the pressure quasi constant.

Energy storage stage: When the liquid injection pump injects the liquid into the hydraulic-pressure-chamber through the injecting pipe, the pressure liquid pushes the piston to move upwardly for storing the pressure liquid, so as to gradually press the gas in the gas-pressure-chamber to the gas-tank; there is an upper seal-ring at the top of the hydraulic-pressure-chamber (SMF, as shown in FIG. 1), when the piston reaches the upper seal-ring, the control system stops injecting the liquid, the control method comprises: (1) there is a liquid filled sensor (MYG) at the top of the hydraulic-pressure-chamber, when the piston presses the upper seal-ring (SMF) and the liquid filled sensor (MYG), the liquid filled sensor sends a signal for stopping injecting the liquid; (2) there is an overpressure-sensor (GYG) at the top of the hydraulic-pressure-chamber on the liquid injecting pipe, while the piston pressing the upper seal-ring (SMF), the piston stops moving, while the liquid injection pump continuously works, so as to continuously increase the pressure in the hydraulic-pressure-chamber; when the pressure in the hydraulic-pressure-chamber reaches the preset overpressure threshold, the overpressure-sensor (GYG) tests that the pressure reaches the threshold, thereby sending the stop instruction to stop the liquid injection pump.

Working stage: When an operational cylinder (GZG, as shown in FIG. 5) needs the pressure liquid, the pressure liquid is injected into the operational cylinder through a discharging pipe under the control of the electrically controlled valve, so as to drive the corresponding mechanism; the high pressure gas transmits the pressure by the piston, for repressing the pressure liquid into the hydraulic-pressure-chamber, so as to make the pressure liquid work on the operational cylinder with a pressure value equal to the pressure value of the high pressure gas.

BRIEF DESCRIPTION OF THE DRAWINGS

In FIG. 1, YLG: pressure-sensor; $QTG_1$: gas-tank of integrated energy-accumulator; $QTQ_1$: gas-chamber of integrated energy-accumulator; $TD_1$: gas-liquid-pipe of integrated energy-accumulator; MYG: liquid filled sensor; SMF: upper seal-ring; RJH: heat exchange pipe; HSG: piston cylinder; QYQ: gas-pressure-chamber; HS: piston; MFQ: sealing ring; YYQ: hydraulic-pressure-chamber; XMF: lower sealing gasket; QYG: liquid lacking sensor; SJK: interface of heat exchange pipe; GYG: overpressure-sensor; PYK: discharging pipe; ZYK: injecting pipe; ZPK: injecting/discharging pipe; DDG: bottom sensor; LYG: liquid leakage pipe; LYGA: liquid leakage reflux pipe; SJY: collected-liquid; DKF: electronically-controlled-valve; TH: spring; WZG: position sensor; $FT_1$: buoy of integrated energy-accumulator; TQK: vent hole of buoy; ZJ: stand; WZG: position sensor: XHX: signal wire; MFT: sealing sleeve; BCK: supply port of high pressure gas; SYT: liquid-container; JYQ: liquid-collector; a full name of liquid-collector is "liquid collecting and leaking device", which comprises (FT: buoy; LYG: liquid leakage pipe; DKF: electronically-controlled-valve; QTG: gas-tank); JYG: collection-liquid sensor; YLY: pressure liquid.

FIG. 1.1 is a stereogram of the buoy $FT_1$ of the integrated energy-accumulator.

In FIG. 1.1, TQK: vent hole of buoy (which communicates internal and external gases of the buoy and equalizes internal and external pressures); NTB: buoy-internal-wall; WTB: buoy-external-wall.

In FIG. 2, references different from FIG. 1 are $FT_2$: buoy of split energy-accumulator; $QTG_2$: gas-tank of split energy-accumulator; $QTQ_2$: gas-chamber of split energy-accumulator; $TD_2$: gas liquid external channel of split energy-accumulator; references same with FIG. 1 are YLG, MYG, SMF, RJH, HSG, QYQ, HS, YYQ, XMF, QYG, SJK, GYG, PYK, ZYK, ZPK, DDG, LYG, LYGA, SJY, DKF, TH, WZG, TQK, ZJ, WZG, XHX, MFT, BCK and SYT.

FIG. 2.1 is a stereogram of the buoy $FT_2$ of the split energy-accumulator. In FIG. 2.1, TQK is vent hole.

FIG. 3 is an external view of a sandwich piston. References same with the above drawings are: BCK, SMF, HSG, QYQ, MFQ, YYQ, XMF, PYK, ZYK and ZPK; references different from the above drawings are HSs: upper-half-piston; $DJ_A$: upper chamfer of upper-half-piston; $DJ_B$: lower chamfer of upper-half-piston; HZ: sliding column; HT: sliding sleeve; $DJ_C$: upper chamfer of lower-half-piston; $DJ_D$: lower chamfer of lower-half-piston; HSx: lower-half-piston; JXC: sandwich layer; RG: flexible tube hose; PN: rubber bladder; ZZK: grease injecting port.

FIG. 3.1 is cross sectional view of the sandwich piston. References same with FIG. 3 are: BCK, SMF, HSG, QYQ, HSs, $DJ_A$, $DJ_B$, HZ, HT, $DJ_C$, $DJ_D$, HSx, JXC, YYQ, RG, XMF, PN, ZZK, PYK, ZYK, ZPK; added references are MFG: sealing cover; ST: bolt head; XCS: stroke bolt; DXF: check valve; XCK: stroke hole; YK: liquid hole.

FIG. 4 shows an electronically-controlled-valve DKF. In FIG. 4, $DK_1$: interface screw; $DK_2$: filtering net; $DK_3$: plunger valve body; $DK_5$: plunger head; $DK_6$: polyhedron hole; $DK_7$: polyhedron column; $DK_8$: screw rod (which is integrated with the polyhedron column); $DK_9$: nut column; $DK_{10}$: locking screw; $DK_{11}$: motor shaft; $DK_{12}$: valve motor; $DK_{13}$: valve sleeve; $DK_{14}$: positioning screw; $DK_{15}$: liquid leakage outlet.

FIG. 4.1 is a cross sectional view of the plunger valve. In FIG. 4.1, $DK_3$: plunger valve body; $DK_4$: plunger valve core; $DK_5$: plunger head.

In FIG. 5, QK: gas hole; SYT: liquid-container; YB: liquid injection pump; ZDZ: driving shaft; LHQ: electromagnetic clutch; LHK: clutch controller; CDZ: driven shaft; ZHF: reflux resistant valve; XNQ: liquid seal energy-accumulator (as shown in dashed line box); RYY: hot liquid source; RYB: hot liquid pump; LYY: cold liquid source; LYB: cold liquid pump; ZYG: pressurized cylinder; $ZF_K$: liquid injecting valve K (wherein K is 1 to n); $ZK_K$: liquid injecting valve controller K; $GZG_K$: operational cylinder K; $PF_K$: liquid discharging valve K; $PK_K$: liquid discharging valve controller K; HYG: liquid reflux tube; HYB: liquid reflux pump.

DETAILED DESCRIPTION OF THE PREFERRED EMBODIMENT

Figure 1:
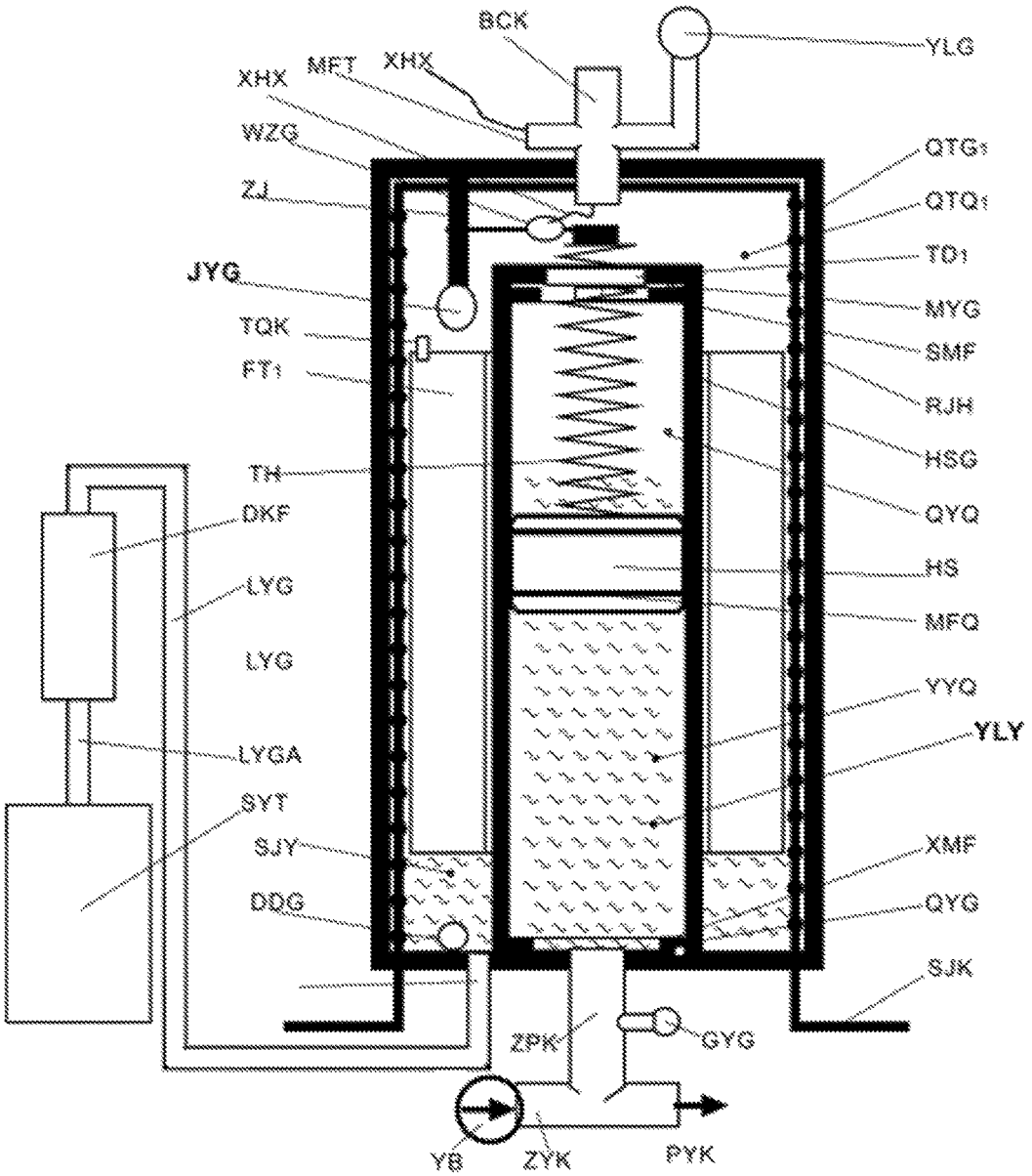
FIG. 1 shows a liquid seal energy-accumulator integrated gas-tank with piston cylinder.

Embodiment 1: Liquid Seal Energy-Accumulator Integrated Gas-Tank with Piston Cylinder (as Shown in FIG. 1)

A sealed cylindrical high pressure gas-tank ($QTG_1$, referred to as "gas-tank") with a large diameter defines a high pressure gas-chamber ($QTQ_1$, referred to as "gas-chamber"), a cylindrical piston cylinder (HSG) with a small diameter is sleeved within the gas-chamber, the gas-tank and the piston cylinder are sealed from each other; the piston cylinder is divided into a gas-pressure-chamber (QYQ) and a hydraulic-pressure-chamber (YYQ) by a piston (HS), a gas-liquid-pipe ($TD_1$) is located at a top of the piston cylinder for communicating the gas-chamber ($QTQ_1$) and the gas-pressure-chamber (QYQ), the high pressure gas is injected by a supply port (BCK), the gas pressure is transmitted to the hydraulic-pressure-chamber (YYQ) by the piston, such that the pressure liquid in the hydraulic-pressure-chamber has a very high pressure; an injecting/discharging pipe (ZPK) is located at a bottom of the hydraulic-pressure-chamber for injecting the pressure liquid to store the pressure energy and discharging the pressure liquid to output the pressure energy.

The gas-tank has two functions: one is the extension of the gas-pressure-chamber (QYQ), and at this point, the gas-tank serves as a high pressure gas-chamber for helping the gas-pressure-chamber to store the high pressure gas, thus increasing a total volume and decreasing a pressure fluctuation of the gas-pressure-chamber; the other is serving as a liquid-collector, because a small amount of leakage always occurs in the piston, the pressure liquid slowly leaks from the hydraulic-pressure-chamber to the gas-pressure-chamber, so that more and more pressure liquid accumulates on the top of the piston which needs to be cleaned up; when the piston moves to a top of the piston cylinder, the pressure liquid on the top of the piston flows into the gas-chamber by the gas-liquid channel, in such a manner that the pressure liquid on the top of the piston is timely cleaned up, and the pressure liquid (collected-liquid SJY) collected at a bottom of the gas-chamber becomes more and more, so that a buoy ($FT_1$) floats higher and higher, when the buoy presses a collection-liquid sensor (JYG), the sensor sends an opening electronically-controlled-valve signal for opening an electronically-controlled-valve (DKF) to release the collected-liquid, the pressure liquid flows from a liquid leakage pipe (LYG) back to a liquid-container (SYT); when the collected-liquid is released, the buoy ($FT_1$) falls off till the buoy presses a bottom sensor (DDG), the bottom sensor sends a closing electronically-controlled-valve signal for closing the electronically-controlled-valve to stop a motor.

The buoy ($FT_1$) is a thin-walled sealing cylinder, a vent hole (TQK) communicates internal with external gas of the buoy to equalize internal and external pressures thereof, so as to avoid flattening the buoy.

Figure 5:
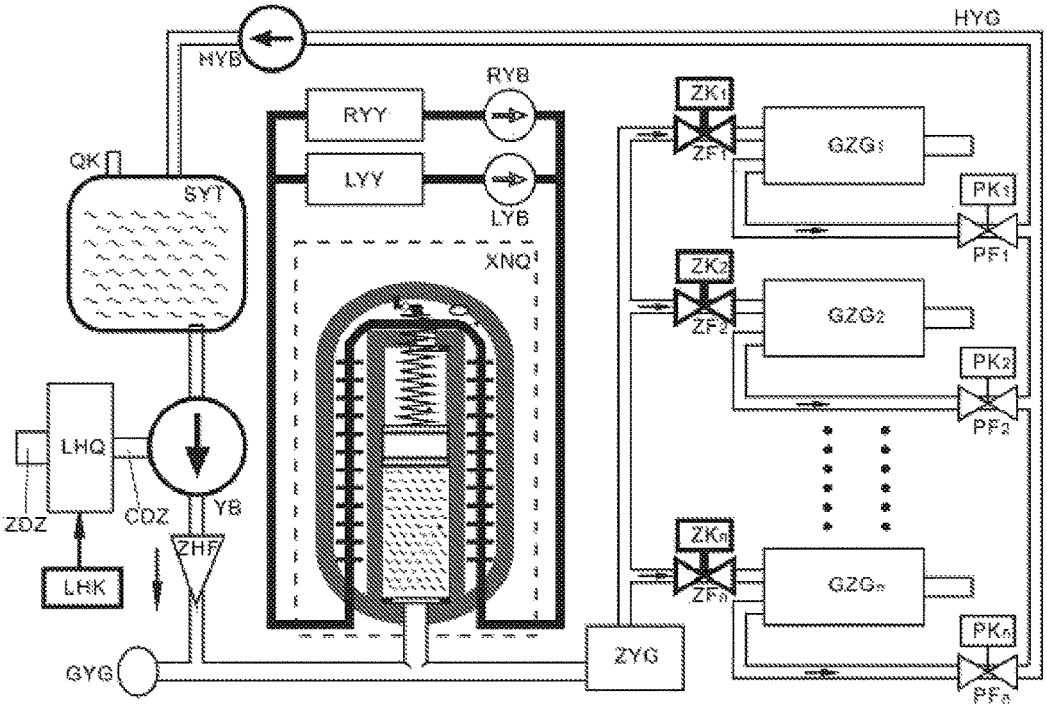
FIG. 5 shows a hydraulic pressure system based on liquid seal energy-accumulator.

A measure for stabilizing the pressure is adjusting the temperature of the high pressure gas to adjust the pressure thereof, so as to achieve the quasi-constant pressure. A controlled heating and cooling device is wound around an inner wall of the gas-tank for several circles, such as the liquid pipe controlled heating device with heat exchange sheets which are wound for several circles, are called as the heat exchange pipe (RJH). A pipeline is connected with the gas-tank, a pressure-sensor (YLG) or a pressure gauge is mounted on the pipeline for monitoring the pressure, the pressure of the gas-chamber changes with moving the piston or changing the environmental temperature, so that the measure needs to be taken to stabilize the pressure. There are two methods to allow the high pressure gas to form the quasi-constant pressure. The first method is that the high pressure gas is in a saturated gaseous state, namely, the high pressure gas whose critical temperature is higher than a temperature control is selected; the pressure of the high pressure gas is the quasi-constant pressure corresponding to the temperature as long as the temperature is controlled to be the quasi-constant pressure. The second method is that the high pressure gas whose critical temperature is lower than the temperature control is selected, the high pressure gas is in a gaseous state or in a super liquid state; the temperature of the high pressure gas is adjusted by detecting the pressure change through the pressure-sensor, so as to adjust the pressure for decreasing the change rate of the pressure fluctuation to form the quasi-constant pressure, which is concretely described as follows:

A hot liquid pump (RYB) and a cool liquid pump (LYB) are controlled by a pressure sensor (YLG). When the pressure is lower than a lower limit value, the pressure-sensor (YLG) sends a heating signal, a hot liquid pump (RYB, as shown in FIG. 5) pumps the circular hot liquid to the heat exchange pipe (RJH) for heating the high pressure gas, the temperature of the high pressure gas is increased for increasing the pressure, so that a signal threshold value of stopping the hot liquid pump is set to a certain point between an upper limit value and the lower limit value of the pressure. For simplification and rationalization, the threshold value is set to a nominal value in the present application, when the pressure is higher than the nominal value, the pressure-sensor/comparator sends a signal to stop heating; when the pressure is higher than the upper limit value, the pressure-sensor sends a cooling signal, a cool liquid pump (LYB) pumps the circular cooling liquid to the hot exchange pipe for cooling the high pressure gas, so that the temperature of the high pressure gas is decreased to decrease the pressure, when the pressure is lower than the nominal value, the pressure-sensor/comparator sends a signal to stop cooling.

Furthermore, the heat exchange pipe (RJH) is replaced by a winding-type controlled heating component for heating the gas-chamber.

Enlarging the total volume of the high pressure gas-chamber is also a measure to stabilize the pressure.

A spring (TH) and a position sensor (WZG) are used to monitor the position of the piston, namely, a height of the liquid, the position sensor is fixed to the top, the spring TH is connected to a bottom of the position sensor and an upper portion of the piston. An extension spring located at an upper portion of the piston is shown in the drawings (a pressure spring located at a lower portion of the piston is possible and has the same principle, so it is not shown). When a liquid level is decreased, the piston moves downwardly, a force applied by the spring (TH) on the position sensor is enlarged, a signal outputted by the position sensor is strengthened; when the force applied by the spring (TH) reaches a preset threshold value, the position sensor/comparator sends a "liquid injecting signal" to a liquid injection pump for starting the liquid injection pump, so as to inject the liquid into a hydraulic-pressure-cylinder till the piston presses an upper seal-ring, and at this time, a sample signal of a length of the spring (TH) stops change, thus a control system judges whether the hydraulic-pressure-chamber needs injecting the pressure liquid or needs stopping injecting the pressure liquid.

Figure 2:
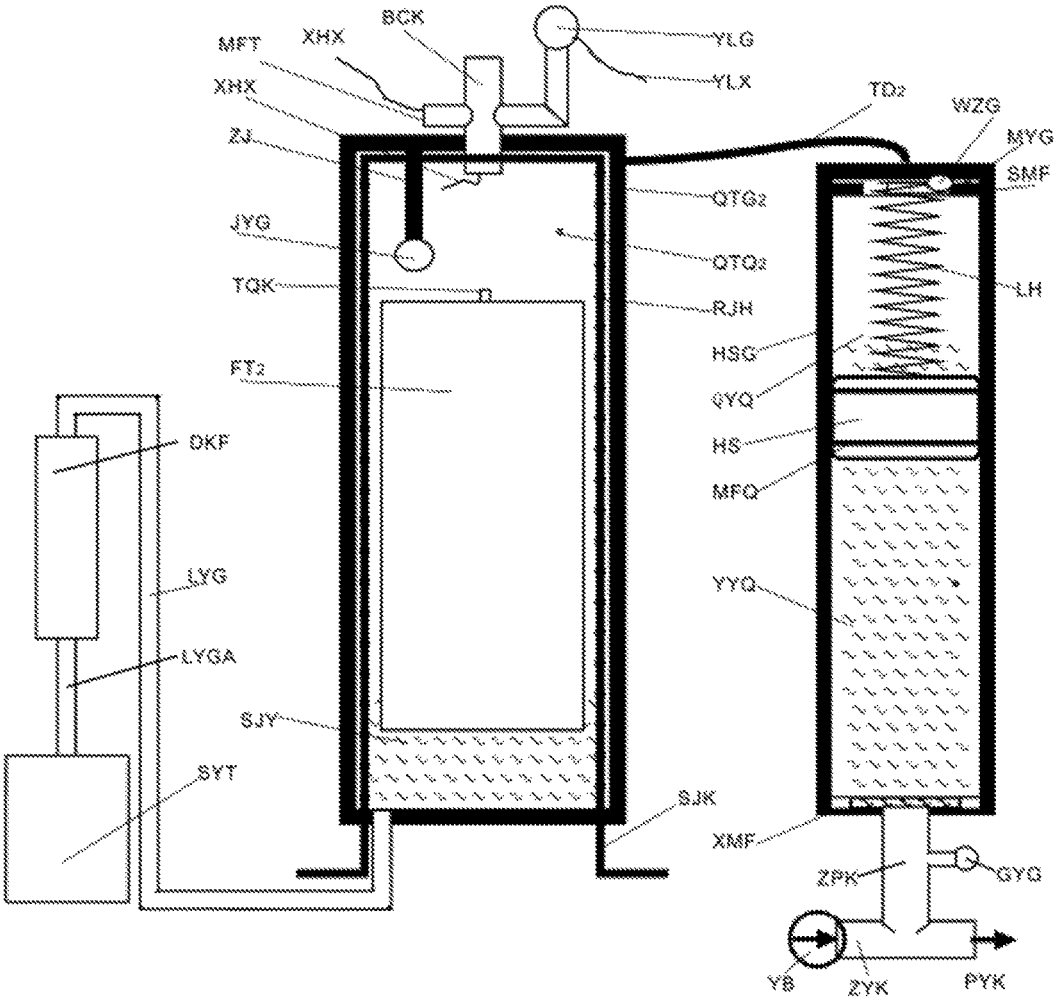
FIG. 2 shows a liquid seal energy-accumulator separated gas-tank from piston cylinder.

Embodiment 2: Liquid Seal Energy-Accumulator Separated Gas-Tank from Piston Cylinder (as Shown in FIG. 2)

In the separable structure, a high pressure gas-tank ($QTG_2$) is relatively independent from the piston cylinder (HSG), a top of the high pressure gas-tank ($QTG_2$) is communicated with a top of the piston cylinder (HSG) by a gas-liquid channel ($TD_2$); when the piston moves to the top, the pressure liquid at the top of the piston flows into a gas-chamber ($QTQ_2$) by the gas-liquid channel ($TD_2$), and the pressure liquid (the collected-liquid SJY) collected at the bottom of the gas-chamber becomes more and more to float a buoy ($FT_2$). Other structures and the working principle of the Embodiment 2 are same as those of the Embodiment 1.

Embodiment 3: Sandwich Piston (FIG. 3 Shows an External View of the Piston and FIG. 3.1 Shows a Sectional View Thereof)

Requirements for improving the piston are: strengthening sealing performance, reducing friction losses, improving reaction sensitivity. Furthermore, to strengthen the sealing performance, a structure combining several sealing methods which include the sealing gasket, the flat liquor sandwich sealing and the chamfer sealing is adopted. The gasket sealing is a conventional method, wherein a groove is provided on the piston and a rubber sealing gasket is inserted into the groove. One of important features in the present invention is to provide the flat liquor sandwich sealing and the chamfer sealing.

Flat liquor sandwich sealing of the piston:

The sandwich piston is a dual piston (which comprises an upper-half-piston (HSs) and a lower-half-piston (HSx)). The lower-half-piston (HSx) and a sliding sleeve (HT) are an integral whole. The upper-half-piston (HSs) and a sliding column (HZ) are an integral whole. A stroke hole (XCK) is provided on the sliding column and is communicated with a sandwich layer through a liquid hole (YK). A stroke bolt (XCS) is inserted into the stroke hole for welding with a bottom of the lower-half-piston (HSx) to form a whole. A sealing cover (MFG) covers the stroke hole for sealing. Accordingly, a sealing space between the upper-half-piston and the lower-half-piston is formed and called as the sandwich layer (JXC). All the sandwich layer, the stroke bolt, the sliding column and the sliding sleeve are in a sealing range. The sliding column matches with the sliding sleeve by a sliding manner. A highest point and a lowest point of a stroke of a bolt head of the stroke bolt is limited by the stroke hole (XCK), so that a largest thickness of the sandwich layer is limited, to avoid detaching the sliding column from the sliding sleeve.

The sandwich layer with a changeable distance, which is full of sealing fat liquid (which is sealing grease or pressure liquid), is formed between the upper-half-piston and lower-half-piston. In principle, n dual pistons form n−1 sandwich layers. A force of the gas pressure and the hydraulic pressure on the piston is much larger than a friction force between the piston and a cylinder body, such that a pressure of the sandwich layer is approximately equal to that of the gas-pressure-chamber, so as to form a micro pressure difference leakage from the high pressure gas to the sandwich layer; the pressure of the sandwich layer is approximately equal to that of the hydraulic-pressure-chamber, so as to form the micro pressure difference leakage from the pressure liquid to the sandwich layer. When the sealing fat liquid of the sandwich layer leaks, it needs to be replenished; a check valve (DXF) is adopted to provide a fat liquid supplement for the sandwich layer, and is located at a middle of the sliding column for saving a space; the sealing fat liquid in the hydraulic-pressure-chamber is able to flow into the sandwich layer through the one-way valve, while the sealing fat liquid in the sandwich layer is unable to flow back to the hydraulic-pressure-chamber through the one-way valve.

Sealing of the fat liquid sandwich layer comprises grease sealing and liquid sealing.

The grease sealing uses the sealing grease to act as the sandwich layer, if the sealing grease of the sandwich layer leaks, under the pressure of the hydraulic-pressure-chamber, the sealing grease stored in a rubber bladder (PN) is replenished to the sandwich layer through a flexible tube hose (RG) and the check valve (DXF). Within the hydraulic-pressure-chamber (YYQ), there is a rubber bladder (PN) with seal oil, through the flexible tube hose (RG and a check valve (DXF) complement sealing grease to sandwich layer.

The liquid sealing uses the pressure liquid to act as the sandwich layer, if the pressure liquid of the sandwich layer leaks, the pressure liquid in the hydraulic-pressure-chamber is replenished to the sandwich layer through the one-way valve; while according to practical experiences, the sandwich layer is also full of the pressure liquid without the one-way valve, thus the one-way valve is optional.

Chamfer Sealing:

It is assumed that the gas and the pressure liquid are mixed in the sandwich layer; the gas is gathered at an upper portion of the sandwich layer, firstly, the gas is gathered at a chamfer ($DJ_B$, namely, lower end face chamfer of the upper-half-piston) which is located at the upper portion of the sandwich layer, so as to prevent the pressure liquid from leaking to the gas-pressure-chamber; while the pressure liquid is gathered at a lower portion of the sandwich layer, firstly, the pressure liquid is gathered at a chamfer ($DJ_C$, namely, upper end face chamfer of the lower-half-piston) which is located at the lower portion of the sandwich layer, so as to prevent the gas from leaking to the hydraulic-pressure-chamber.

Similarly, it is assumed that the gas is injected into the hydraulic-pressure-chamber, the gas is firstly gathered at a lower end face chamfer of the lower-half-piston ($DJ_D$), and then pushed to the sandwich layer; it is assumed that the pressure liquid is injected into the gas-pressure-chamber, the pressure liquid is firstly gathered at an upper end face chamfer of the upper-half-piston ($DJ_A$) and then pushed to the sandwich layer.

Therefore, the chamfer sealing strengthens intercepting not only the leakage of the gas to the hydraulic-pressure-chamber, but the leakage of the pressure liquid to the gas-pressure-chamber.

Embodiment 4: Electronically-Controlled-Valve DKF Liquid Leakage Device

When the electronically-controlled-valve (DKF) is closed, the collected-liquid (SW) with the gas-chamber (QTQ) becomes more and more, which makes the buoy (FT) float higher and higher; when the buoy presses the collection-liquid sensor (JYG), the JYG sends a signal for opening the electronically-controlled-valve (DKF) and leaving out the collected-liquid. The electronically-controlled-valve (DKF) comprises a valve-motor ($DK_{12}$), the axis ($DK_{11}$) of the valve-motor ($DK_{12}$) drives a nut column ($DK_9$) to rotate, there is a screw ($DK_8$) in the nut column ($DK_9$), the screw column ($DK_8$) with a polyhedron column ($DK_7$) fixed with each other and is stuck by a polyhedron column ($DK_7$), the polyhedron column ($DK_7$) is stuck in a polyhedron hole $DK_6$ and unable to rotate, and can only move up along with the positive rotation of the nut column ($DK_9$), and move down along with the reverse rotation of the nut column ($DK_9$), when it moves upward and pushes the plunger ($DK_5$), opens the electronically-controlled-valve (DKF), thereby going through the liquid leakage pipe (LYG), the pressure fluid flows back to liquid-container (SYT). When the collected-liquid (SJY) is released, the buoy (FT) will decline, there is a bottom sensor (DDG) on the bottom of the hydraulic-pressure-chamber, when the buoy presses the bottom sensor (DDG), the DDG sends a signal for closing the electronically-controlled-valve (DKF), after the electronically-controlled-valve (DKF) receives the closing signal, the valve-motor ($DK_{12}$) reversely rotates, to make polyhedron column $DK_7$ move downward, the electronically-controlled-valve (DKF) is closed under the effect of the pressure, and finally the valve-motor ($DK_{12}$) stops.

The electronically-controlled-valve (DKF) can also adopt known other type mechanical and electrical valves.

Embodiment 5: Hydraulic Pressure System Based on Liquid Sealing Energy-Accumulator Energy Storage Stage:

A liquid injection pumping (YB) connected to the injecting/discharging pipe (ZPK) injects the pressure liquid to the hydraulic-pressure-chamber (YYQ). When the liquid level is decreased, an elasticity of the spring (TH) is increased, the signal outputted by the position sensor (WZG) is strengthened; when the signal is larger than a preset "liquid supplement threshold", the position sensor/comparator sends the "liquid injecting signal" to the liquid injection pump for starting the liquid injection pump, so as to inject the liquid into the hydraulic-pressure-cylinder. There are two methods to drive the liquid injection pump: one is engine driving, when the sensor/comparator sends the "liquid injecting signal" to the liquid injection pump; a liquid lacking sensor (QYG) is used to control a clutch controller (LHK) and further control the mesh/separate of the electromagnetic clutch (LHQ), when the hydraulic-pressure-chamber (YYQ) is short of liquid, the liquid lacking sensor (QYG) sends an "injection signal" to the injection pump; a clutch controller (LHK, as shown in FIG. 5) allows an electromagnetic clutch (LHQ) to engage, a driving shaft (ZDZ) drives a driven shaft (CDZ) for driving the liquid injection pump (YB), so as to pump the pressure liquid from the liquid-container (SYT) into the hydraulic-pressure-chamber (YYQ); the other way is motor driving, one motor is connected with the liquid injection pump (YB), when the liquid lacking sensor (QYG) sends the "liquid injecting signal" to the liquid injection pump (YB), the motor is started to drive the liquid injection pump(YB) for pumping the pressure liquid in the liquid-container into the hydraulic-pressure-chamber. While injecting the liquid, the pressure liquid pushes the piston to upwardly move for gradually squeezing the gas in the gas-chamber back to the gas-tank, so that the pressure liquid gradually occupies the space of the gas-chamber, the piston stops moving till pressing the upper seal-ring (SMF) of the hydraulic-pressure-cylinder, the pressure liquid does not enter the hydraulic-pressure-chamber any longer; while under the effect of the pumping pressure, the pressure of the hydraulic-pressure-chamber is continuously increased till reaching the preset overpressure threshold, a liquid filled sensor (MYG) sends a stop instruction for stopping the liquid injection pump.

Working stage: The hydraulic system comprises a set of operational cylinder ($GZG_K$), when the operational cylinder ($GZG_K$) needs the pressure liquid, the working valve k ($PF_K$) turns ON by the working valve controller ($ZK_K$), the pressure fluid flows from the hydraulic-pressure-chamber (YYQ) and is injected into the operational cylinder ($GZG_K$). The subscript k is the wildcard of the subscript 1, 2, . . . , n. When an operational cylinder ($GZG_K$) needs the pressure liquid, the pressure liquid is injected into the operational cylinder through a discharging pipe under the control of the electrically controlled valve, so as to drive the corresponding mechanism; the high pressure gas transmits the pressure through the piston, for repressing the pressure liquid in the hydraulic-pressure-chamber, so as to allow the pressure liquid to work on the operational cylinder with a pressure value equal to the high pressure gas.

A pressurized cylinder (ZYG) is optional. It is adopted when the pressure thereof is much higher than the pressure of the hydraulic-pressure-cylinder.

What is claimed is:

1. A liquid seal energy-accumulator, comprising:

a sealed cylindrical high pressure gas-tank (QTG), a sealing cylindrical piston cylinder (HSG), a piston (HS), a gas-liquid-pipe (TD), an injecting/discharging pipe (ZPK), a liquid injection pump (YB), a liquid leakage pipe (LYG), a liquid-container (SYT), an electronically-controlled-valve (DKF), a liquid filled sensor (MYG), a collection-liquid sensor (JYG), a buoy (FT), a bottom sensor (DDG), wherein:

the gas-tank (QTG) defines a high pressure gas-chamber (QTQ);

the piston (HS) divides the piston cylinder (HSG) into a gas-pressure-chamber (QYQ) and a hydraulic-pressure-chamber (YYQ), the hydraulic-pressure-chamber (YYQ) is full of pressure liquid (YLY), the gas-pressure-chamber (QYQ) is injected with high pressure gas, the gas-liquid-pipe (TD) is located at a top of the piston cylinder (HSG) and communicates the gas-chamber (QTQ) with the gas-pressure-chamber (QYQ);

the injecting/discharging pipe (ZPK) is located at a bottom of the hydraulic-pressure-chamber (YYQ) and comprises an injecting pipe (ZYK) and a discharging pipe (PYK), wherein the injecting pipe (ZYK) is connected with the liquid injection pump (YB) through which the pressure liquid (YLY) is injected into the hydraulic-pressure-chamber (YYQ) for storing pressure energy, and the discharging pipe (PYK) is adapted for outputting the pressure energy to a load;

the liquid leakage pipe (LYG) is located at a bottom of the gas-tank (QTG) and is connected with the liquid-container (SYT) through the electronically-controlled-valve (DKF);

all of the collection-liquid sensor (JYG), the buoy (FT) and the bottom sensor (DDG) are located within the gas-chamber (QTQ), the collection-liquid sensor (JYG) is located above the buoy (FT), the bottom sensor (DDG) is located at a bottom of the gas-chamber (QTQ) and below the buoy (FT);

due to high pressure in the hydraulic-pressure-chamber (YYQ), the pressure liquid (YLY) leaks around the piston, enters the gas-pressure-chamber (QYQ) and gathers on the piston (HS), in such a manner that when the piston (HS) moves towards the top of the piston cylinder (HSG), the pressure liquid (YLY) which gathers on the piston (HS) flows into the gas-chamber (QTQ) through the gas-liquid-pipe (TD), is collected at the bottom of the gas-chamber (QTQ) and is called a collected-liquid (SJY), such that when the collected-liquid (SJY) is increased to drive the buoy (FT) to move upwardly until the buoy (FT) presses the collection-liquid sensor (JYG), the collection-liquid sensor (JYG) sends a signal to turn on the electronically-controlled-valve (DKF), so as to discharge the collected-liquid (SJY) to flow towards the liquid-container (SYT) through the electronically-controlled-valve (DKF) and the liquid leakage pipe (LYG); when the collected-liquid (SJY) is discharged to drive the buoy (FT) to move downwardly until the buoy (FT) presses the bottom sensor (DDG), the bottom sensor (DDG) sends another signal to turn off the electronically-controlled-valve (DKF).

2. The liquid seal energy-accumulator, as recited in claim 1, wherein the piston (HS) comprises an upper-half-piston (HSs), a lower-half-piston (HSx), a sliding sleeve (HT), a sliding column (HZ), a stroke bolt (XCS), a check valve (DXF) and a sealing cover (MFG), wherein:

a sealing space is provided between the upper-half-piston (HSs) and the lower-half-piston (HSx) and is defined as a sandwich layer (JXC);

the upper-half-piston (HSs) and the sliding column (HZ) are integrally formed, the lower-half-piston (HSx) and the sliding sleeve (HT) are integrally formed;

the sliding column (HZ) has a stroke hole (XCK) therein which is communicated with the sandwich-layer through a liquid hole (YK), the stroke bolt (XCS) is inserted into the stroke hole (XCK) and is integrally welded with a bottom of the lower-half-piston (HSx), the sealing cover (MFG) covers the stroke hole (XCK) for forming sealing;

the upper-half-piston (HSs) slidably matches with the lower-half-piston (HSx) by the sliding column (HZ) and the sliding sleeve (HT), so as to form the sandwich layer (JXC) which has a changeable distance between the upper-half-piston (HSs) and the lower-half-piston (HSx); the sandwich layer (JXC) is full of sealing grease liquid;

a highest point and a lowest point of a stroke of a bolt head (ST) of the stroke bolt (XCS) is limited by the stroke hole (XCK), so that a largest thickness of the sandwich layer (JXC) is limited, to avoid detaching the sliding column (HZ) from the sliding sleeve (HT);

the check valve (DXF) is located at a middle of the stroke bolt (XCS) for saving a space; when the sealing grease liquid in the sandwich layer (JXC) leaks, the check valve (DXF) provides a replenishment of the sealing grease liquid to the sandwich layer (JXC), and prevents the sealing grease liquid from the sandwich layer (JXC) back to the hydraulic-pressure-chamber (YYQ).

3. The liquid seal energy-accumulator, as recited in claim 2, wherein the sealing grease liquid comprises sealing grease and the pressure liquid (YLY);

when the sandwich layer (JXC) is full of the sealing grease, both a rubber bladder (PN) with the sealing grease and a flexible tube hose (RG) are disposed within the hydraulic-pressure-chamber; once the sealing grease in the sandwich layer (JXC) leaks, the rubber bladder (PN) provides the sealing grease for the sandwich layer (JXC) through the flexible tube hose (RG), the check valve (DXF), the stroke hole (XCK) and the liquid hole (YK);

when the sandwich layer (JXC) is full of the pressure liquid (YLY), once the pressure liquid (YLY) in the sandwich layer (JXC) leaks, the pressure liquid (YLY) in the hydraulic-pressure-chamber (YYQ) is supplied to the sandwich layer (JXC) by the check valve (DXF), the stroke hole (XCK) and the liquid hole (YK).

4. The liquid seal energy-accumulator, as recited in claim 3, wherein chamfers are located at edges of the upper-half-piston (HSs) and the lower-half-piston (HSx).

5. The liquid seal energy-accumulator, as recited in claim 4, wherein the buoy (FT) is a thin-walled sealing cylinder and has a vent hole (TQK) which communicates internal gas with external gas of the buoy (FT) to equalize internal and external pressures thereof, so as to avoid flattening the buoy (FT).

6. The liquid seal energy-accumulator, as recited in claim 5, further comprising a spring (TH) and a position sensor (WZG) both of which are configured to monitor a position of the piston (HS), wherein:

the position sensor (WZG) is fixed to a top of the piston cylinder (HSG), the spring (TH) is connected between a bottom of the position sensor (WZG) and the top of the piston (HS);

when a liquid level of the pressure liquid (YLY) in the piston cylinder (HSG) is decreased, the piston (HS) moves downwardly, a force applied by the spring (TH) on the position sensor (WZG) is enlarged, a signal outputted by the position sensor (WZG) is strengthened; when the force applied by the spring (TH) reaches a threshold value, the position sensor (WZG) sends a liquid injecting signal to the liquid injection pump (YB) for starting the liquid injection pump (YB), so as to inject liquid into the hydraulic-pressure-chamber (YYQ) until the piston (HS) presses an upper seal-ring (SMF) of the piston cylinder (HSG), and at this time, a sample signal of a length of the spring (TH) stops changing for judging whether the hydraulic-pressure-chamber (YYQ) needs to inject the pressure liquid (YLY) or needs to stop injecting the pressure liquid (YLY).

7. The liquid seal energy-accumulator, as recited in claim 1, wherein: a diameter of the gas-chamber (QTQ) is larger than a diameter of the piston cylinder (HSG).

8. A hydraulic system with a liquid seal energy-accumulator, comprising the liquid seal energy-accumulator and a temperature regulating stabilizing pressure device, wherein:

the energy-accumulator comprises:

a sealed cylindrical high pressure gas-tank (QTG), a sealing cylindrical piston cylinder (HSG), a piston (HS), a gas-liquid-pipe (TD), an injecting/discharging pipe (ZPK), a liquid injection pump (YB), a liquid leakage pipe (LYG), a liquid-container (SYT), an electronically-controlled-valve (DKF), a liquid filled sensor (MYG), a collection-liquid sensor (JYG), a buoy (FT), a bottom sensor (DDG), wherein:

the gas-tank (QTG) defines a high pressure gas-chamber (QTQ);

the piston (HS) divides the piston cylinder (HSG) into a gas-pressure-chamber (QYQ) and a hydraulic-pressure-chamber (YYQ), the hydraulic-pressure-chamber (YYQ) is full of pressure liquid (YLY), the gas-pressure-chamber (QYQ) is injected with high pressure gas, the gas-liquid-pipe (TD) is located at a top of the piston cylinder (HSG) and communicates the gas-chamber (QTQ) with the gas-pressure-chamber (QYQ);

the injecting/discharging pipe (ZPK) is located at a bottom of the hydraulic-pressure-chamber (YYQ) and comprises an injecting pipe (ZYK) and a discharging pipe (PYK), wherein the injecting pipe (ZYK) is connected with the liquid injection pump (YB) through which the pressure liquid (YLY) is injected into the hydraulic-pressure-chamber (YYQ) for storing pressure energy, and the discharging pipe (PYK) is adapted for outputting the pressure energy to a load:

the liquid leakage pipe (LYG) is located at a bottom of the gas-tank (QTG) and is connected with the liquid-container (SYT) through the electronically-controlled-valve (DKF);

all of the collection-liquid sensor (JYG), the buoy (FT) and the bottom sensor (DDG) are located within the gas-chamber (QTQ), the collection-liquid sensor (JYG) is located above the buoy (FT), the bottom sensor (DDG) is located at a bottom of the gas-chamber (QTQ) and below the buoy (FT);

due to high pressure in the hydraulic-pressure-chamber (YYQ), the pressure liquid (YLY) leaks around the piston, enters the gas-pressure-chamber (QYQ) and gathers on the piston (HS), in such a manner that when the piston (HS) moves towards the top of the piston cylinder (HSG), the pressure liquid (YLY) which gathers on the piston (HS) flows into the gas-chamber (QTQ) through the gas-liquid-pipe (TD), is collected at the bottom of the gas-chamber (QTQ) and is called a collected-liquid (SJY), such that when the collected-liquid (SJY) is increased to drive the buoy (FT) to move upwardly until the buoy (FT) presses the collection-liquid sensor (JYG), the collection-liquid sensor (JYG) sends a signal to turn on the electronically-controlled-valve (DKF), so as to discharge the collected-liquid (SJY) to flow towards the liquid-container (SYT) through the electronically-controlled-valve (DKF) and the liquid leakage pipe (LYG); when the collected-liquid (SJY) is discharged to drive the buoy (FT) to move downwardly until the buoy (FT) presses the bottom sensor (DDG), the bottom sensor (DDG) sends another signal to turn off the electronically-controlled-valve (DKF);

the temperature regulating stabilizing pressure device comprises a heating or cooling device, which winds around an inner wall of the gas-tank of the energy-accumulator, so that a pressure of the high pressure gas is adjusted by adjusting a temperature of the high pressure gas, so as to achieve a pressure quasi constant.

9. The hydraulic system, as recited in claim 8, wherein:

a heat exchange pipe with heat exchange sheets winds around the inner wall of the gas tank of the energy-accumulator, and a pressure sensor is installed on the gas-tank for monitoring the pressure;

the pressure sensor is configured to control a heat liquid pump and a cold liquid pump, when the pressure is lower than a lower limit value, the pressure sensor sends a heating signal, the heat liquid pump pumps hot liquid to the heat exchange pipe for heating the high pressure gas, the temperature of the high pressure gas is increased for increasing the pressure, when the pressure is higher than a nominal valve, the pressure sensor sends a signal for stopping heating;

when the pressure is higher than an upper limit value, the pressure sensor sends a cooling signal, the cold liquid pump pumps the cooling liquid to the heat exchange pipe for cooling the high pressure gas, so that the temperature of the high pressure gas is decreased to decrease the pressure, when the pressure is lower than the nominal value, the pressure sensor sends a signal to stop cooling.

* * * * *